US005909864A

United States Patent [19]

Wang

[11] Patent Number: 5,909,864

[45] Date of Patent: Jun. 8, 1999

[54] CHAIR-MOUNT ADJUSTABLE KEYBOARD SUPPORTING ASSEMBLY

[75] Inventor: Chih Chiang Wang, Hsin Tien, Taiwan

[73] Assignee: Camel Furniture Co., Ltd., Tu Cheng, Taiwan

[21] Appl. No.: 09/047,873

[22] Filed: Mar. 25, 1998

[51] Int. Cl.[6] ..... A47F 5/00; A47C 7/54

[52] U.S. Cl. ..... 248/289.11; 248/284.1; 248/285.1; 297/173; 297/411.33

[58] Field of Search ..... 248/289.11, 291.1, 248/292.12, 292.13, 292.14, 285.1, 286.1, 298.1, 276.1, 274.1, 278.1, 281.11, 299.1, 118, 118.1, 918, 284.1; 297/144, 160, 161, 162, 173, 411.33, 411.35, 411.38

[56] References Cited

U.S. PATENT DOCUMENTS

| | | | |
|---|---|---|---|
| 819,917 | 4/1906 | Ruger | 297/173 |
| 2,954,955 | 10/1960 | Feller | 248/231.41 |
| 3,968,992 | 7/1976 | Hogan | 297/162 |
| 4,836,486 | 6/1989 | Vossoughi et al. | 248/281.11 |
| 4,844,388 | 7/1989 | Kuba et al. | 108/5 |
| 5,398,901 | 3/1995 | Brodmann et al. | 248/288.51 |
| 5,429,336 | 7/1995 | Ko | 248/278.1 |
| 5,476,304 | 12/1995 | Gulliver et al. | 297/173 |
| 5,553,820 | 9/1996 | Karten et al. | 248/286.1 |
| 5,653,499 | 8/1997 | Goodall | 297/170 |

*Primary Examiner*—Ramon O. Ramirez
*Assistant Examiner*—Anita M. King
*Attorney, Agent, or Firm*—Pro-Techtor International Services

[57] ABSTRACT

Disclosed is a chair-mount adjustable keyboard supporting assembly mainly including an n-shaped bracket connected to a bottom side of a chair to hold lower ends of two outward and parallelly extended extension bars. The extension bars are bent inward at a lower portion to pivotally connect a main base to their upper ends. A rotating seat is rotatably mounted about a central shaft of the main base. A suspension arm having one end inserted into the rotating seat extends its another end into an inclination adjusting seat. A keyboard supporter is fixedly mounted onto the inclination adjusting seat for holding a keyboard thereon. The inclination adjusting seat can be pivotally turned about the suspension arm to adjust the forward inclination of the keyboard supporter relative to the chair to which the assembly is mounted. The rotating seat can be rotated about the central shaft of the main base to adjust the lateral angular position of the keyboard supporter relative to the chair.

2 Claims, 3 Drawing Sheets

CHAIR-MOUNT ADJUSTABLE KEYBOARD SUPPORTING ASSEMBLY

BACKGROUND OF THE INVENTION

The present invention relates to a chair-mount adjustable keyboard supporting assembly, and more particularly to a chair-mount keyboard supporting assembly which allows three-dimensional positional and angular adjustment of a keyboard disposed thereon relative to a chair to which the assembly is mounted.

A full set of computer basically includes a main frame, a monitor, and a keyboard. The main frame and the monitor usually have predetermined dimensions and volumes and therefore occupy a lot of room. Most commercially available office desks and/or computer desks have specific specifications and a desktop having a limited surface area. As an expediential method, an additional drawer type space is provided below the computer desk or general office desk for positioning the keyboard. Such drawer type space conveniently supplements insufficient surface area of the desktop. However, following drawbacks are found from the drawer type space for keyboard:

1. The drawer type space cannot be adjusted in its orientation, angle, and inclination and is therefore not necessarily comfortably suitable for every operators.
2. Since the drawer type space is provided below the desktop, the keyboard positioned thereon is lower than the desktop and close to the monitor. The operator needs to shift his or her head up and down at a big angle when his or her view shifts between the monitor and the keyboard. The operator tends to become easily tired after a short operating time.

On the other hand, none of the existing office chairs or chairs particularly designed for computer operators has been provided with any structure for holding a keyboard or other peripheral equipment. The chairs are of no use in terms of helping to eliminate the mess on the desktop.

SUMMARY OF THE INVENTION

It is therefore a primary object of the present invention to provide a chair-mount adjustable keyboard supporting assembly, so that a keyboard can be positioned on the chair-mount supporting assembly without occupying additional room on the limited desktop.

Another object of the present invention is to provide a chair-mount adjustable keyboard supporting assembly, so that a keyboard positioned thereon can be adjusted in its inclination and orientation relative to the operator to a position most suitable to the operator.

BRIEF DESCRIPTION OF THE DRAWINGS

The above and other objects and the technical means adopted by the present invention to achieve these objects can be best understood by referring to the following detailed description of the preferred embodiments and the accompanying drawings, wherein.

DETAILED DESCRIPTION OF THE PREFERRED EMBODIMENTS

Figure 1:
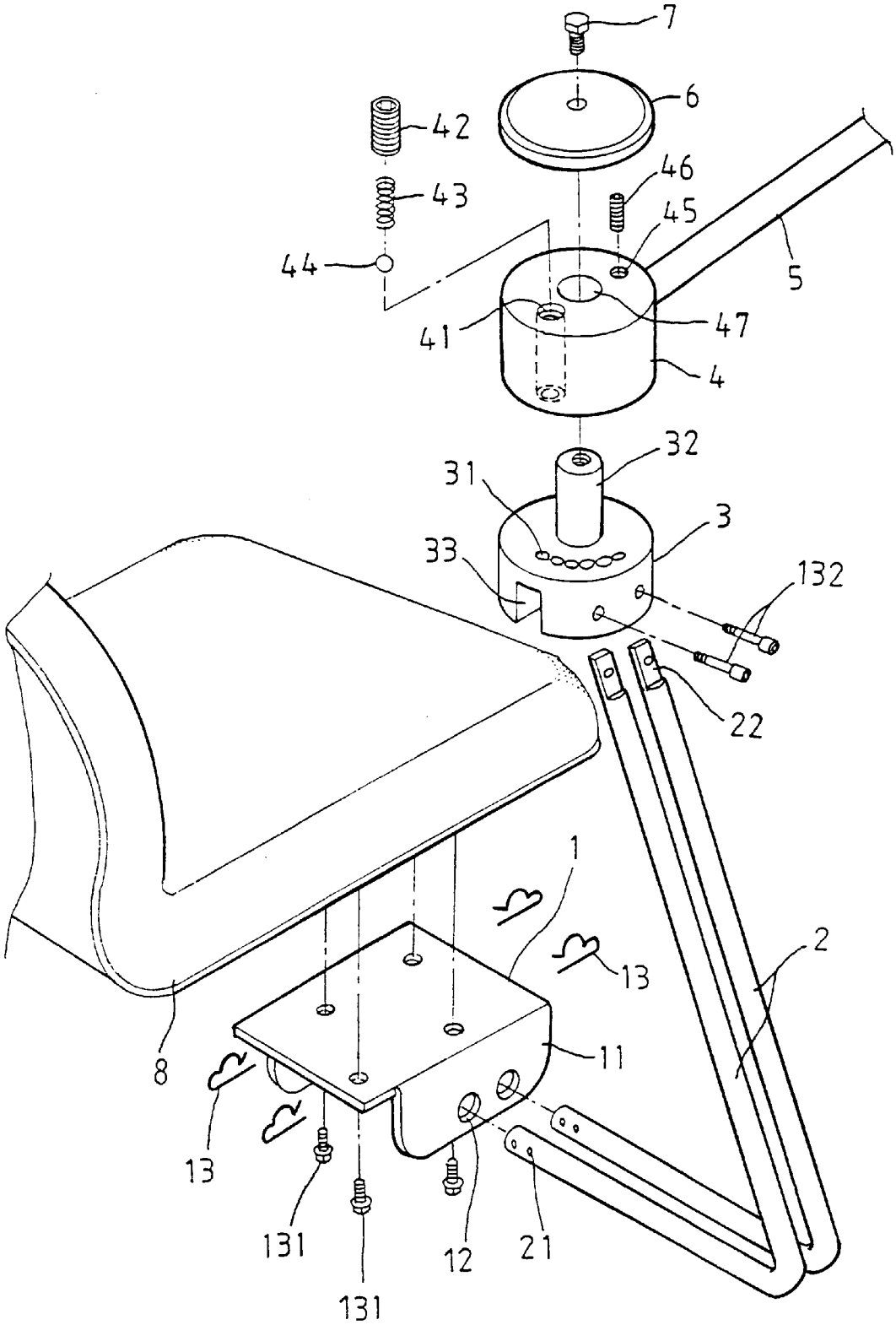
FIG. 1 is an exploded perspective of the present invention.
Figure 2:
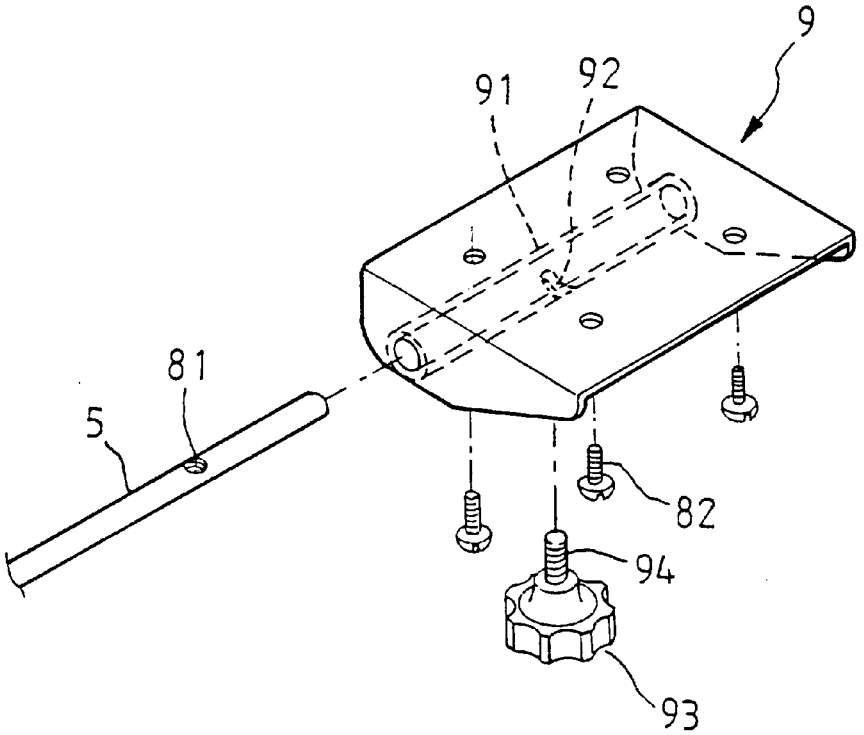
FIG. 2 is an exploded perspective showing the assembling of an inclination adjusting seat to a suspension arm of the present invention.

Please refer to FIGS. 1 and 2 that are exploded perspectives of the present invention. As shown, the present invention mainly includes a bracket 1 connected to a chair 8, a pair of extension bars 2, a main base 3, a rotating seat 4, a suspension arm 5, and an inclination adjusting seat 9.

The bracket 1 is connected to one bottom side of the chair 8 by means of screws 131 upward screwed into a seat bottom of the chair 8. Two sides of the bracket 1 parallel to the bottom side of the chair 8 extending downward to form two side walls 11, giving the bracket 1 an n-shaped cross section. Two pairs of through holes 12 are separately and correspondingly formed on the two side walls 11.

The two extension bars 2 extend in parallel with one another and both are bent at a lower portion to form an angle of about 60 degrees. Each of the extension bars 2 has an upper end forming a pivotal connecting head 22 and a lower end provided with two through holes 21. The extension bars 2 extend their lower ends through the two pairs of through holes 12 on the two side walls 11 of the bracket 1 and are pivotally turnably fastened to and below the bracket 1 by multiple pieces of retaining means 13.

The main base 3 is provided with a channel 33 which extends across a bottom of the main base 3 for receiving the two pivotal connecting heads 22 of the two extension bars 2 therein. Two screws 132 are threaded from one side of the main base 3 into the channel 33 to extend through the pivotal connecting heads 22. A central shaft 32 upward projects from an upper surface of the main base 3. And a plurality of shallow holes 31 are continuously formed on the upper surface of the main base 3 along outer periphery thereof in an arcuate row.

The rotating seat 4 has an axial central through hole 47 for receiving the central shaft 32 of the main base 3 therein. An internally threaded hole 41 is axially formed on the rotating seat 4 at a predetermined position for an adjusting screw 42 to thread thereinto. A spring 43 is disposed in the threaded hole 41 below the adjusting screw 42 to normally press a locating ball 44 against one of the shallow holes 31 on the main base 3, so that the rotating seat 4 can be rotated about the central shaft 32 and then located at a desired position relative to the main base 3. Another internally threaded hole 45 is also provided on the rotating seat 4 diametrically opposite to the threaded hole 41. A screw 46 is threaded into the hole 45 to tightly press against the suspension arm 5 which has one end sideward inserted into the rotating seat 4 in a predetermined manner. A top cover 6 is fixed to a top of the rotating seat 4 by a screw 7 threaded into the central shaft 32 to complete the rotatable mounting of the rotating seat 4 onto the main base 3.

The inclination adjusting seat 9, as shown in FIG. 2, is formed of a transverse arm passage 91 for receiving another end of the suspension arm 5 therein. An oblong adjusting opening 92 is provided at a bottom center of the arm passage 91. An adjusting wheel 93 having a threaded stem 94 is upward extended through the oblong adjusting opening 92 with the threaded stem 94 screwed into a threaded hole 81 formed on the suspension arm 5. When the adjusting wheel 93 is turned to tightly screw the threaded stem 94 against the suspension arm 5, the inclination adjusting seat 9 can be fixedly mounted about the suspension arm 5. Please refer to FIGS. 4 and 5. In a practical use of the present invention, the inclination adjusting seat 9 is fixed to a bottom side of a keyboard supporter 10 by means of several screws 82 upward screwed through the inclination adjusting seat 9 into the keyboard supporter 10.

Figure 3:
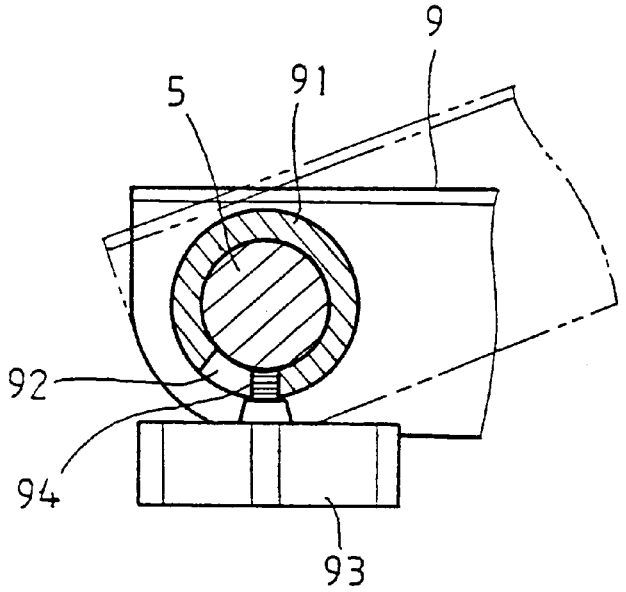
FIG. 3 is an assembled side sectional view of FIG. 2 showing the angular adjustment of the inclination adjusting seat relative to the suspension arm.

Please now refer to FIG. 3. When the adjusting wheel 93 is rotated in a reverse direction to loosen the threaded stem 94 from the threaded hole 81 of the suspension arm 5, the inclination adjusting seat 9 can be pivotally swung about the suspension arm 5 to an inclined position relative to the chair 8. When the inclination adjusting seat 9 is adjusted to a desired inclined position, the adjusting wheel 93 can be rotated to tighten the suspension arm 5 to the inclination adjusting seat 9 again. By this way, the keyboard supporter 10 can be inclinedly adjusted at the same time to meet the user's need.

Figure 4:
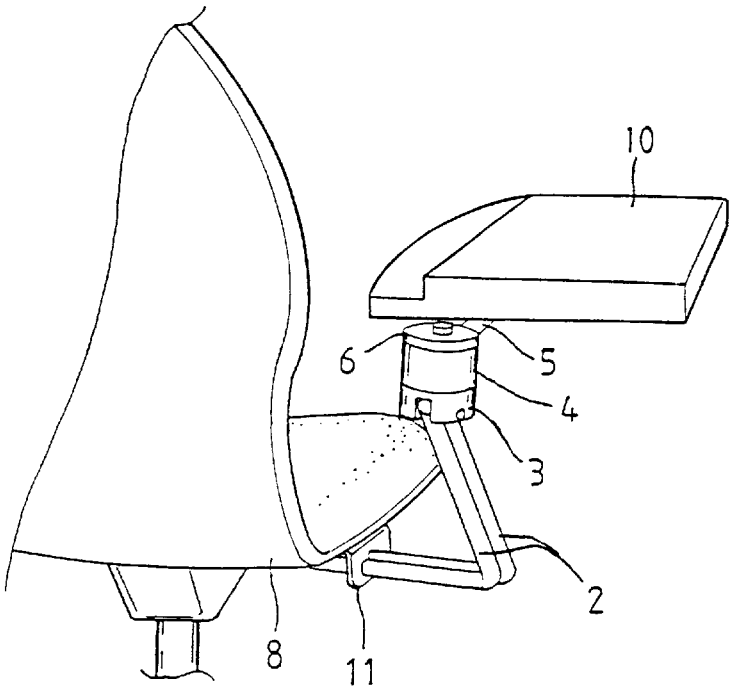
FIG. 4 is a perspective showing the present invention in a withdrawn position when it is not in use.
Figure 5:
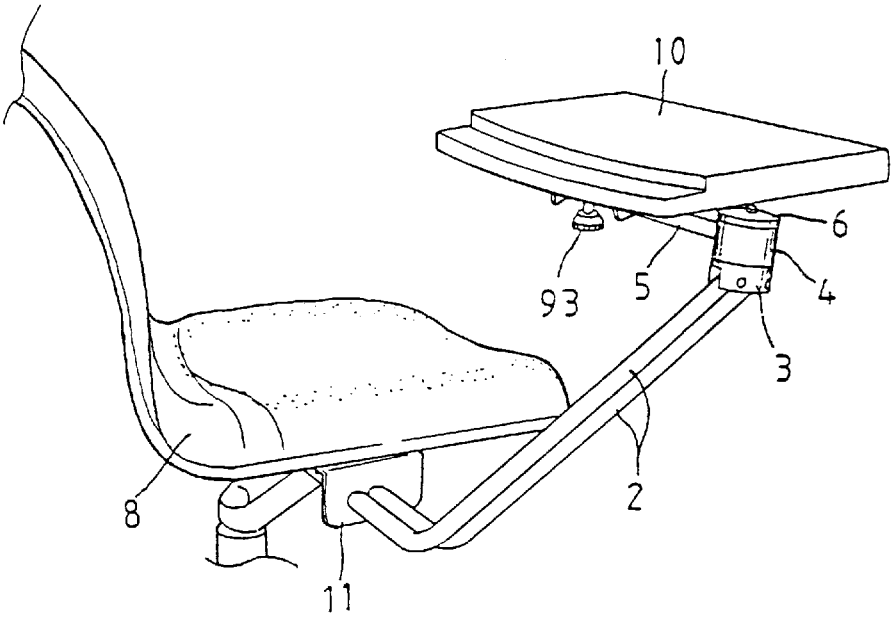
FIG. 5 is a perspective showing the present invention in an extended position when it is in use.

FIGS. 4 and 5 are perspectives showing the present invention in withdrawn and extended positions, respectively. When the present invention is not in use, the two extension bars 2 are turned about the pairs of through holes 12 relative to the bracket 1, so that the extension bars 2 are withdrawn to bring the main base 3, the rotating seat 4, the suspension arm 5, and the inclination adjusting seat 9 assembled to the upper ends of the extension bars 2 close to the chair 8. At this point, the rotating seat 4 may be turned to allow the suspension arm 5 to extend in a direction parallel to the lateral side of the chair 8, so that the present invention occupies a minimized space to one side of the chair 8. And, when the present invention is to be used, turn the two extension bars 2 in similar way but let their upper portions extend outward away from the chair 8. Meanwhile, adjust the rotating seat 4 so that the suspension arm 5 extends in a direction parallel to a front edge of the chair 8. The rotating seat 4 can be rotated and the inclination adjusting seat 9 can be inclined all depend on the user's actual need.

With the above arrangements, the present invention allows a keyboard to be more conveniently positioned in front of a chair and be properly adjusted in its inclination and angular position relative to the user, so that the user may operate the keyboard in an optimal condition most suitable for the user to obtain an increased work efficiency.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A chair-mount adjustable keyboard supporting assembly, comprising a bracket connected to a chair, a pair of extension bars, a main base, a rotating seat, a suspension arm, and an adjusting seat;

said bracket being connected to one bottom side of said chair by means of screws upward screwed into a seat bottom of said chair, two sides of said bracket parallel to the bottom side of said chair extending downward to form two side walls, two pairs of through holes being separately and correspondingly formed on said two side walls;

said two extension bars both being bent at a lower portion to form a predetermined angle, each of said extension bars having an upper end forming a pivotal connecting head and a lower end provided with two through holes, said extension bars extending their lower ends through said two pairs of through holes on said two side walls of said bracket and being pivotally turnably fastened to and below said bracket by retaining means;

said main base being provided with a channel which extends across a bottom of said main base for receiving said two pivotal connecting heads of said two extension bars therein, two screws being threaded from one side of said main base into said channel to extend through said pivotal connecting heads, said main base having an upward projected central shaft and an arcuate row of continuous shallow holes formed along outer periphery of said main base;

said rotating seat having an axial central through hole for receiving said central shaft of said main base therein and an axially extended first threaded hole formed at a predetermined position for an adjusting screw to thread thereinto, a spring being disposed in said first threaded hole below said adjusting screw to normally press a locating ball against and into one of said shallow holes on said main base, a second threaded hole being provided on said rotating seat diametrically opposite to said first threaded hole for a screw to thread thereinto to tightly press against said suspension arm which has one end sideward inserted into said rotating seat in a predetermined manner, and a top cover being fixed to a top of said rotating seat by a screw threaded into said central shaft of said main base, so that said rotating seat is rotatably mounted around said central shaft of said main base; and said inclination adjusting seat being formed of a transverse arm passage for receiving another end of said suspension arm therein, an oblong adjusting opening being provided at a bottom center of said arm passage, an adjusting wheel having a threaded stem being upward extended through said oblong adjusting opening with said threaded stem screwed into a threaded hole formed on said suspension arm, whereby when said adjusting wheel is turned to tightly screw said threaded stem against said suspension arm, said inclination adjusting seat is fixedly mounted about said suspension arm at a desired inclination relative to said chair, and a keyboard supporter being connected to a top of said inclination adjusting seat by screws to hold a keyboard thereon.

2. A chair-mount adjustable keyboard supporting assembly as claimed in claim 1, wherein said two extension bars extend in parallel with one another and are bent inward at their lower portion to form an angle about 60 degrees.

* * * * *